US006135074A

United States Patent [19]

Kuhl

[11] Patent Number: 6,135,074

[45] Date of Patent: Oct. 24, 2000

[54] TAPPET FOR THE VALVE GEAR MECHANISM OF AN INTERNAL COMBUSTION ENGINE

[75] Inventor: Mario Kuhl, Herzogenaurach, Germany

[73] Assignee: Ina Walzlager Schaeffler oHG, Germany

[21] Appl. No.: 09/147,874

[22] PCT Filed: Jun. 13, 1997

[86] PCT No.: PCT/EP97/03089

§ 371 Date: Mar. 18, 1999

§ 102(e) Date: Mar. 18, 1999

[87] PCT Pub. No.: WO98/16726

PCT Pub. Date: Apr. 23, 1998

[30] Foreign Application Priority Data

Oct. 16, 1996 [DE] Germany ..... 196 42 718

[51] Int. Cl.[7] ..... F01L 13/00

[52] U.S. Cl. ..... 123/90.16; 123/90.48

[58] Field of Search ..... 123/90.15, 90.16, 123/90.17, 90.48, 90.49, 90.5, 90.55, 198 F

[56] References Cited

U.S. PATENT DOCUMENTS

| | | | |
|---|---|---|---|
| 5,203,289 | 4/1993 | Hara et al. | 123/90.16 |
| 5,343,833 | 9/1994 | Shirai | 123/90.16 |
| 5,603,294 | 2/1997 | Kawai | 123/90.16 |
| 5,651,335 | 7/1997 | Elendt et al. | 123/90.16 |
| 5,694,894 | 12/1997 | Allen | 123/90.16 |
| 5,709,180 | 1/1998 | Spath | 123/90.16 |
| 5,782,216 | 7/1998 | Haas et al. | 123/90.16 |
| 5,950,583 | 9/1999 | Kraxner et al. | 123/90.16 |

FOREIGN PATENT DOCUMENTS

| | | |
|---|---|---|
| 2952037 | 6/1981 | Germany . |
| 3526542 | 2/1986 | Germany . |
| 4329590 | 3/1995 | Germany . |
| 4405189 | 8/1995 | Germany . |
| 2162246 | 1/1986 | United Kingdom . |

*Primary Examiner*—Weilun Lo
*Attorney, Agent, or Firm*—Bierman, Muserlian and Lucas

[57] ABSTRACT

A tappet (1) comprises an annular section (2) which concentrically surrounds a circular section (5). The two sections (2, 5) can be loaded by cams (4, 7) of different lift and be coupled to each other when desired by radially displaceable sliders (11, 14). To avoid switching errors, the slider (11) extending in the annular section (2) can be selectively prevented from being displaced by a piston (26) which comprises a control edge (28) and is displaceable in the longitudinal direction of the tappet (1). For this purpose, the piston (26) cooperates with a groove (29) of a cam (4) starting from a second part (β) of the base circle of the cam. During this part (β) of the base circle, the piston (26) can be displaced by hydraulic medium pressure in cam direction into the groove (29) so that it extends with its control edge (28) in an annular groove (30 or 31) of the first slider (11) and thus locks this slider (11) out of its desired displacement phases.

12 Claims, 2 Drawing Sheets

TAPPET FOR THE VALVE GEAR MECHANISM OF AN INTERNAL COMBUSTION ENGINE

This application is a 371 of PCT/EP97/03089 filed Jun. 13, 1997.

DESCRIPTION

1. Field of the Invention

The invention concerns a tappet for a valve train of an internal combustion engine, said tappet being designed to be switched to different valve lifts including a tappet (1) for a valve train of an internal combustion engine, which tappet (1) can be switched to different valve lifts and is comprised of an outer annular section (2) which concentrically surrounds a circular section (5) which is axially displaceable relative thereto, both sections (2,5) being loadable in lift direction in the regions of their bottoms (3,6) by cams of different lifts, or at least one section being loadable by at least one cam in the lift direction, each of the sections (2,5) comprising in the region of its bottom (3,6) at least one reception (9,10) extending radially said receptions (9,10) being aligned to each other in a cam base circle phase, there being arranged in the reception (9) of the annular section (2) a first slider (11) which is displaceable by a servo means towards the reception (10) of the circular section (5), and said first slider (11), for realizing un uncoupling of the sections (2,5) extends with an inner end face (12) up to a position immediately in front of an annular surface (13) between the sections (2,5), and, for realizing a coupling of the sections (2,5), acts on a second slider (14) which extends through an entire length of the reception (10) of the circular section (5), so that both sliders (11,14) overlap the annular surface (13) by their peripheral surfaces (20,21) to establish a coupled state.

2. Background of the Invention

A tappet of the pre-cited type is known from DE-OS 43 14 619 and does not need to be described more closely here. A drawback of this tappet is that it comprises no means to exclude switching errors of its pistons which function as coupling means. The pressure-medium loaded pistons receive no information as to when it is technically appropriate to overlap the annular surface between the two parts of the tappet. Since such a tappet is switched, as a rule, in the base circle phase of the cam in which its two sections are aligned to each other in the region of their bottoms, it is possible, for example, at high engine rotation speeds, or due to other influences such as pressure medium fluctuations and the like that, when leaving the base circle of the cam, i.e. at the start of the run-on flank, the coupling means have not yet reached their position of coupling or uncoupling as the case may be. If, in this transition state, the coupling means concerned overlaps the annular surface between the two sections only slightly, cam lift on the outer section can break off leading to a destruction of components or to an extreme noise generation.

OBJECT OF THE INVENTION

It is therefore the object of the invention to create a tappet of the pre-cited type in which the mentioned drawbacks are eliminated and, more particularly, using simple means, to create a mechanism which excludes switching errors in the aforementioned operating states, that is to say, a mechanism which enables an axial displaceability of the coupling means only in the base circle phase.

SUMMARY OF THE INVENTION

The invention comprising a tappet (1) for a valve train of an internal combustion engine, which tappet (1) can be switched to different valve lifts and is comprised of an outer annular section (2) which concentrically surrounds a circular section (5) which is axially displaceable relative thereto, both sections (2,5) being loadable in lift direction in the regions of their bottoms (3,6) by cams of different lifts, or at least one section being loadable by at least one cam in the lift direction, each of the sections (2,5) comprising in the region of its bottom (3,6) at least one reception (9,10) extending radially said receptions (9,10) being aligned to each other in a cam base circle phase, there being arranged in the reception (9) of the annular section (2) a first slider (11) which is displaceable by a servo means towards the reception (10) of the circular section (5), and said first slider (11), for realizing un uncoupling of the sections (2,5) extends with an inner end face (12) up to a position immediately in front of an annular surface (13) between the sections (2,5), and, for realizing a coupling of the sections (2,5), acts on a second slider (14) which extends through an entire length of the reception (10) of the circular section (5), so that both sliders (11,14) overlap the annular Surface (13) by their peripheral surfaces (20,21) to establish a coupled state, characterized in that one of the sliders (11 or 14) whose section (2 or 5) cooperates with a cam (4 or 7) is surrounded on its peripheral surface (20 or 21) at least partially by a recess (25) of a piston (26) or a piston-like element, the piston (26) or the piston-like element is displaceable in an axial direction of the tapped (1) by a servo means, and the recess (25) comprises a cam-remote control edge (28) which engages the slider (11 or 14), the piston (26) or the piston-like element extends through an aperture (27) of the bottom concerned (3 or 6) and cooperates with a groove (29) extending in a peripheral direction on the outer peripheral surface (38) of the associated cam (4 or 7), said groove (29) starts on a second part (β) of the base circle, one of the sliders (11 or 14) comprises two annular grooves (30,31) into which the control edge (28) of the piston (26) or the piston-like element can be selectively displaced when said piston (26) or piston-like element is simultaneously engaged in the groove (29) of the associated cam (4 or 7), and the annular grooves (30,31) are spaced from each other so that when the control edge (28) displaced into the radially inner annular groove (30), the sliders (11, 14) extend entirely within their respective receptions (9,10) for uncoupling the sections (2,5) and when the control edge (28) is displaced into the radially outer annular groove (31), the peripheral surfaces (20,21) of the sliders (11,14) overlap the annular surface (13) between the sections (2,5) for coupling the sections (2,5).

The measures of the invention provide a simple technical means for delivering information to the tappet as to when it is in communication with the base circle of the cam. In this way, the initially mentioned switching errors are substantially excluded, and coupling and uncoupling by the piston which cooperates with the annular grooves of the slider are permitted only during a first part of the base circle of the associated cam.

The entire device is configured so that the piston, or another similarly suitable element, is displaced into the groove of the cam when the sliders have to be locked in place. It is proposed to load the piston in its locking direction by a servo means such as a hydraulic medium. However, it is also conceivable to spring load the piston in the locking direction by a compression spring or by a combination of hydraulic medium pressure and the force of a compression spring. The pressing force of the piston is adjustable through its cross-section and through the hydraulic medium pressure. It is also conceivable to use other mechanisms for this purpose, such as magnetic, electromagnetic or purely mechanical means and the like. Further, the piston may have a geometric shape quite different from the one shown in the drawing, the only important thing being that the sliders are retained in their pre-determined position. The biasing of the piston towards the cam by hydraulic medium pressure provides the advantage of a certain elasticity of the piston in cam-remote direction so that indefinite switching states do not result in a destruction of components.

According to the invention, the locked position of the sliders is established trigger-like via a groove in the outer peripheral surface of the cam. However, other geometric shapes such as elevations and the like may also be used in place of the groove to trigger the locking step. But, in this case, the switching mechanism would have to be appropriately modified.

In an advantageous embodiment of the invention, the piston is arranged in the region of the bottom of the annular section. This has the advantage over an arrangement in the circular section that the annular section is in almost permanent contact with its cam and reliable switching information can thus be transmitted to the sliders even in the switched-off state of the tappet.

The subject matter of the invention also includes the arranging of a common pressure chamber under a tappet-side end of the piston for a simultaneous pressure medium supply to the associated slider. This pressure chamber is designed for a servo means such as hydraulic medium. Alternatively, a separate supply of hydraulic medium may be implemented for the slider and the piston starting from the outer peripheral surface of the tappet. Insofar as the tappet also comprises a hydraulic clearance compensation mean, a three-way supply of hydraulic medium to the tappet is also conceivable.

Due to the fact that the outer slider comprises a bore starting from its radially outer end, a further radial enlargement of design space for creating a pressure chamber in front of this slider can be dispensed with.

According to a further proposition of the invention, a return displacement of the sliders in uncoupling direction is achieved by the force of a compression spring. However, the invention likewise includes solutions in which the sliders are also displaced back into their uncoupling position by a hydraulic medium or another servo means. It is further possible to configure the piston so that its cam-proximate edge is made as a control edge. In this case, according to the invention, the control edge comprises a reinforcement which may, for instance, take the form of needles or balls or the like. It is equally possible to reinforce only the edge region itself or to provide the edge region with a wear-resistant coating.

BRIEF DESCRIPTION OF THE DRAWINGS

The invention will now be described more closely with the help of the drawings in which.

DETAILED DESCRIPTION OF THE DRAWINGS

Figure 1:
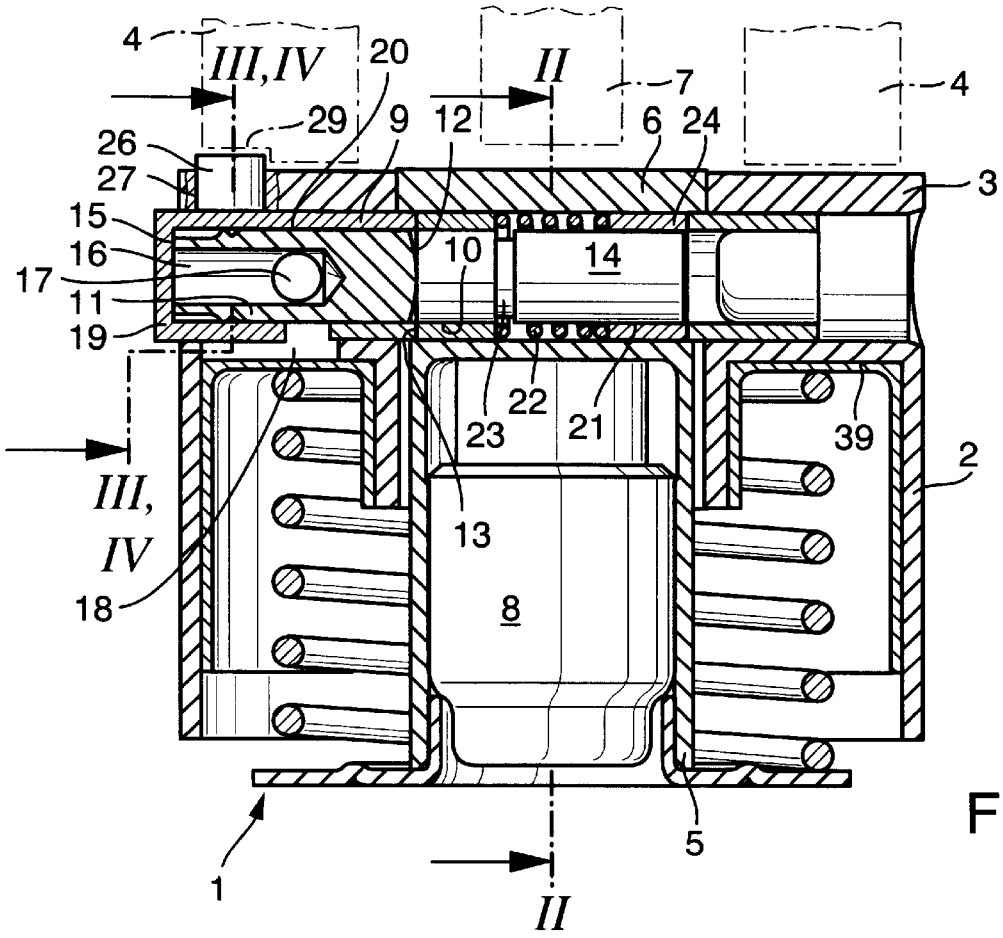
FIG. 1 is a longitudinal section through a tappet comprising the features of the invention, taken along the intersection line shown in FIG. 2.
Figure 2:
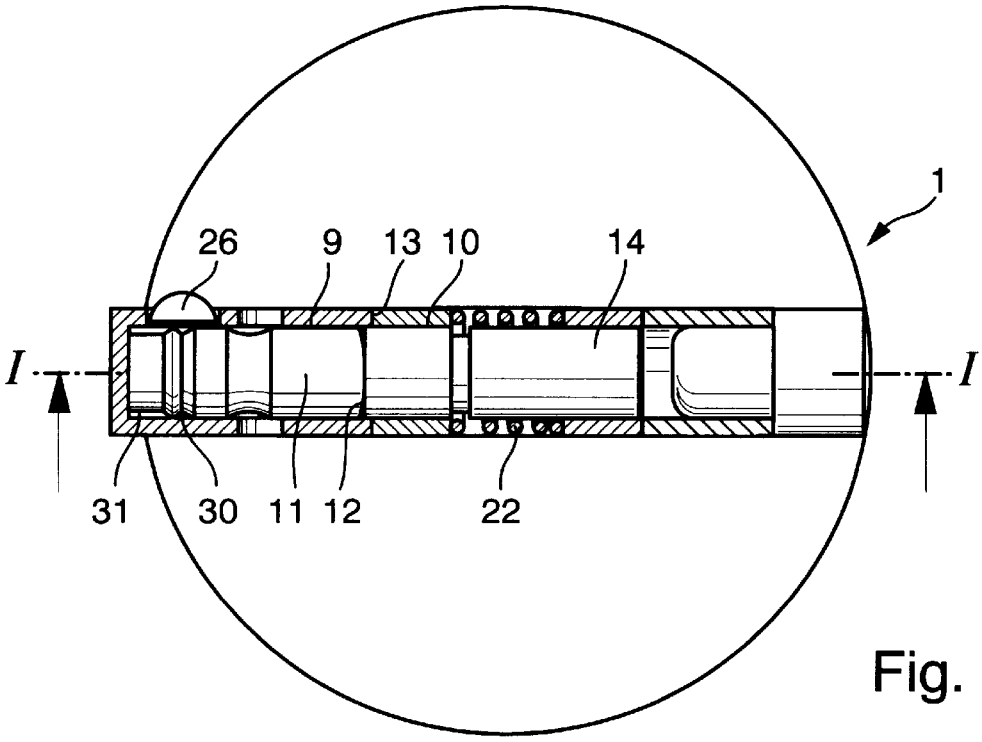
FIG. 2 is a cross-section through a tappet according to FIG. 1 in the region of its sliders.

FIG. 1 shows a tappet of a kind known, per se, in the technical field. The tappet 1 comprises an outer annular section 2 having a bottom 3 which is loaded by two high lift cams 4 in lifting direction. The annular section 2 concentrically surrounds a circular section 5. This circular section 5 is loaded in the region of its bottom 6 by a low or zero lift cam 7. It is also possible to reverse the cam arrangement, but then, the outer annular section 2 would have to cooperate with a gas exchange valve, not shown. In the instant example, the circular section 5 cooperates through a hydraulic clearance compensation element 8, not described further, with at least one gas exchange valve of the internal combustion engine.

Each of the sections 2, 5 possesses in the region of its bottom 3, 6, a radially extending reception, 9 and 10 respectively, and these receptions 9, 10 are aligned to each other in the base circle of the cams 4, 7 associated to the sections 2, 5. These receptions 9, 10 are made in the present case as bores. A first, radially inwards displaceable slider 11 is disposed in the first reception 9 of the annular section 2. This slider 11 has the geometry of a piston and extends in the uncoupled state of the sections 2, 5, with an inner end face 12 immediately in front of an annular surface 13 between the sections 2, 5. A second slider 14 is arranged radially inwards behind the slider 11 in the reception 10 of the circular section 5, and said second slider 14 extends preferably through the entire length of the reception 10 of the circular section 5 and is likewise configured as a piston.

Due to the position of the sliders 11, 14 in the state represented in FIG. 1, the tappet 1 follows only the lift of the cam 7 in this state. To switch the tappet 1 to the lift of the high lift cams 4, hydraulic medium can be routed to the radially outer end face 15 of the first slider 11. To optimize design space, the slider 11 comprises a bore 16 starting from its outer end face 15. This bore 16 comprises a radial opening 17 into which hydraulic medium can be fed from a pressure chamber 18 situated in axial direction therebelow. Radially outwards, the reception 9 is delimited by a plug 19 on which the slider 11 can, but must not be supported through its end face 15. In the present embodiment, the plug 19 is pot-shaped and serves at the same time as a slideway for the slider 11. The plug 19 and the slideway may also be made as separate components, in which case, the slideway is configured as a bushing.

When it is desired to establish a coupling of the two sections 2, 5 in the base circle phase of the cams 4, 7, the slider 11 is displaced radially inwards by applied hydraulic medium pressure so that its peripheral surface 20 overlaps the annular surface 13. At the same time, the slider 11 acts through its inner end face 12 on the second slider 14 so that the peripheral surface 21 thereof overlaps the annular surface 13 on the opposite side and extends partially in a further part of the reception 9 of the section 2. The reception 9 is bored preferably in a single work step.

A return displacement of the sliders 11, 14 for uncoupling the sections 2, 5 is achieved in the present embodiment by the force of a spring means 22 in the form of a compression spring surrounding the second slider 14. At the end of the spring means 22 nearer the first slider 11, at least one coil of the spring means 22 is retained in an annular groove 23 of the second slider 14, the spring means 22 being supported at the other end on a diameter reduction 24 of the reception 10. This diameter reduction 24 can serve, at the same time, for example, as a bushing and slideway for the second slider 14. Due to this configuration, it is not necessary to arrange an additional slider opposite the first slider 11 in the annular section 2.

As a person skilled in the art can further see from FIGS. 1 to 4, the first slider 11 is partially surrounded by a recess 25 of a piston 26 which is displaceable in the longitudinal direction of the tappet 1. This piston 26 extends in cam direction through an aperture 27 in the bottom 3 of the annular section 2.

A cam-remote portion of the recess 25 possesses an edge 28 configured as a control edge. At the same time, the associated cam 4 comprises at least in the second part β of its base circle, a groove 29 extending in peripheral direction. In addition, the first slider 11 comprises two axially spaced annular grooves 30, 31 (see particularly FIG. 2). When, as described more closely in the introductory part of the specification, the sliders 11, 14 have to be held during the second part β of the cam base circle in the position shown in FIG. 1 for uncoupling, the piston 26 is loaded in cam direction on its cam-remote end face 32 by the hydraulic medium pressure provided by the pressure chamber 18, so that a part of the control edge 28 of the piston 26 extends in the annular groove 30. In this way, the sliders 11, 14 are prevented from being axially displaced, and switching errors are thus reliably excluded in a relatively simple manner.

For a coupling of the sections 2, 5, which is advantageously realized in a first part α of the base circle of the cam 4, the sliders 11, 14 are pushed radially from the left to the right as seen in FIG. 1. When the coupling position is reached, and this is the normally the case during a rotation of the cam, the piston 26, assisted by the hydraulic medium, engages into the groove 29 by its cam-proximate end 33 at the start of the groove 29 and extends at the same time with its control edge 28 in the outer annular groove 31. In this case, too, indefinite movements of the sliders 11, 14 are prevented.

Figure 3:
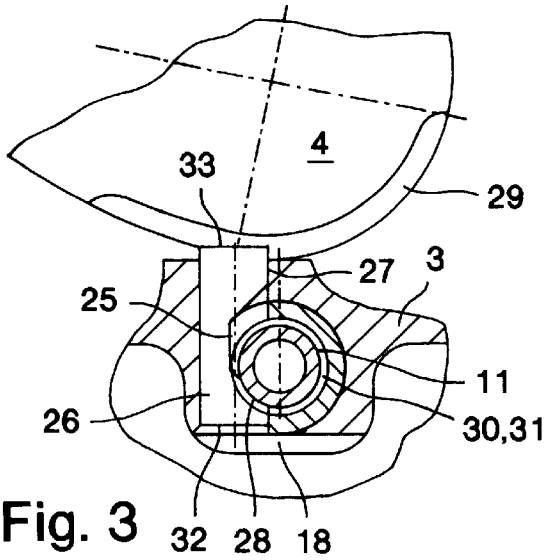
FIGS. 3, 4 are longitudinal sections through the tappet of FIG. 1, taken along the intersection line of FIG. 1 and showing the coupled and the uncoupled state respectively, of the piston.

For a better understanding, FIG. 3 shows the piston 26 extending into the groove 29 of the cam 4. The control edge 28 is engaged in one of the annular grooves 30 or 31.

Figure 4:
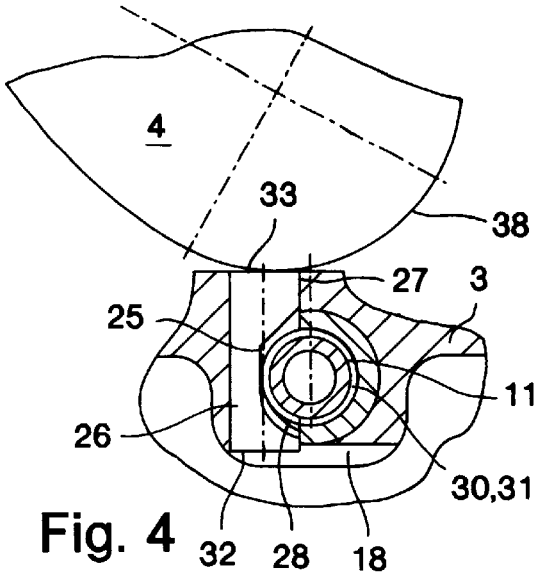
Figure 5:
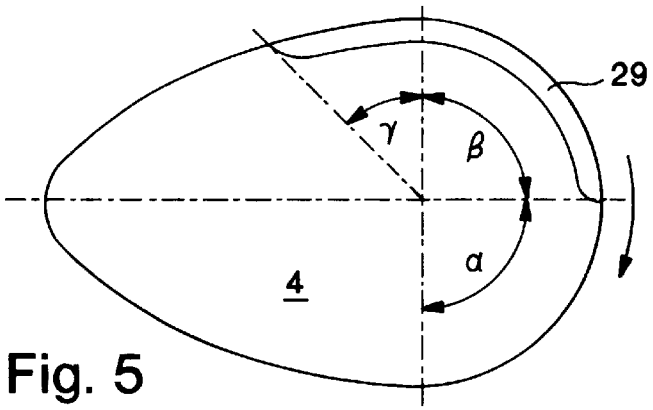
FIG. 5 is a schematic representation of a grooved cam for loading the annular section.

In contrast, FIG. 4 shows the piston 26 in its uncoupled position. The control edge 28 has released the slider 11 which is thus freely movable during the base circle phase α of the cam 4.

Figure 6:
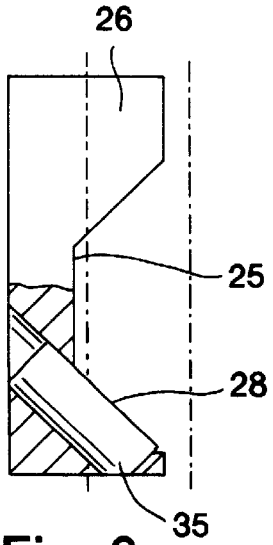
FIGS. 6–8 are enlarged representations of the piston showing special configurations of the control edge.
Figure 7:
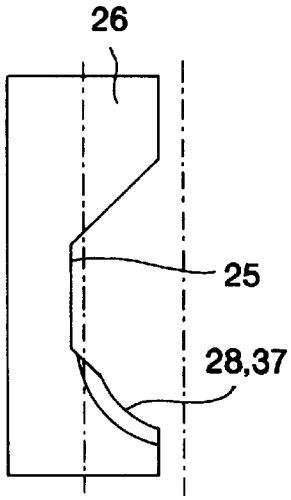
Figure 8:
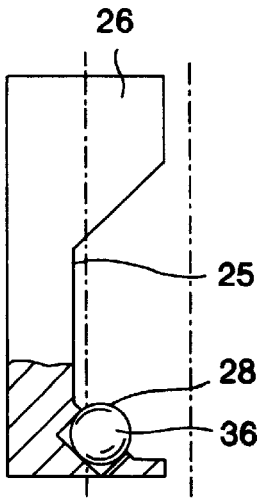

FIGS. 6 to 8 show special alternatives for configuring the control edge 28 of the piston 26. For example, FIG. 6 shows that the control edge 28 can be reinforced with a needle 35, or FIG. 8, that it can be provided with a ball 36. It is understood that a variety of reinforcement elements, needing no further description here, will come to the mind of a person skilled in the art. FIG. 7 shows further that the control edge 28 can be made in one piece with the rest of the piston 26 and comprise, for example, a reinforcement 37 for reducing wear.

What is claimed is:

1. A tappet (1) for a valve train of an internal combustion engine, which tappet (1) can be switched to different valve lifts and is comprised of an outer annular section (2) which concentrically surrounds a circular section (5) which is axially displaceable relative thereto, both sections (2,5) being loadable in lift direction in the regions of their bottoms (3,6) by cams of different lifts, or at least one section being loadable by at least one cam in the lift direction, each of the sections (2,5) comprising in the region of its bottom (3,6) at least one reception (9,10) extending radially, said receptions (9,10) being aligned to each other in a cam base circle phase, there being arranged in the reception (9) of the annular section (2) a first slider (11) which is displaceable by a servo means towards the reception (10) of the circular section (5), and said first slider (11), for realizing un uncoupling of the sections (2,5) extends with an inner end face (12) up to a position immediately in front of an annular surface (13) between the sections (2,5), and, for realizing a coupling of the sections (2,5), acts on a second slider (14) which extends through an entire length of the reception (10) of the circular section (5), so that both sliders (11,14) overlap the annular surface (13) by their peripheral surfaces (20,21) to establish a coupled state, characterized in that one of the sliders (11 or 14) whose section (2 or 5) cooperates with a cam (4 or 7) is surrounded on its peripheral surface (20 or 21) at least partially by a recess (25) of a piston (26) or a piston-like element, the piston (26) or the piston-like element is displaceable in an axial direction of the tapped (1) by a servo means, and the recess (25) comprises a cam-remote control edge (28) which engages the slider (11 or 14), the piston (26) or the piston-like element extends through an aperture (27) of the bottom concerned (3 or 6) and cooperates with a groove (29) extending in a peripheral direction on the outer peripheral surface (38) of the associated cam (4 or 7), said groove (29) starts on a second part (β) of the base circle, one of the sliders (11 or 14) comprises two annular grooves (30,31) into which the control edge (28) of the piston (26) or the piston-like element can be selectively displaced when said piston (26) or piston-like element is simultaneously engaged in the groove (29) of the associated cam (4 or 7), and the annular grooves (30,31) are spaced from each other so that when the control edge (28) displaced into the radially inner annular groove (30), the sliders (11, 14) extend entirely within their respective receptions (9,10) for uncoupling the sections (2,5) and when the control edge (28) is displaced into the radially outer annular groove (31), the peripheral surfaces (20,21) of the sliders (11,14) overlap the annular surface (13) between the sections (2,5) for coupling the sections (2,5).

2. A tappet according to claim 1, characterized in that the piston (26) or the piston-like element is arranged in the annular section (2).

3. A tappet according to claim 2, characterized in that the servo means for displacing the piston (26) or the piston-like element is a hydraulic medium.

4. A tappet according o claim 3, characterized in that a pressure chamber (18) for the hydraulic medium extends axially under a cam-remote end (32) of the piston (26), said pressure chamber (18) being closed in cam-remote direction by a ring (39) which borders on the annular section (2).

5. A tappet according to claim 4, characterized in that a common supply of hydraulic medium pressure to a radially outer end face (15) of the first slider (11) and to the piston (26) is provided from the pressure chamber (18).

6. A device according to claim 5, characterized in that the radially outer end face (15) of the first slider (11) comprises a bore (16) and, in the uncoupled state, bears against a plug (19) which closes the reception (9) of the first slider (11) in radially outward direction, the bore (16) comprising at least one radial opening (17) which is in hydraulic communication with the pressure chamber (18).

7. A tappet according to claim 2, characterized in that the groove (29) of the cam (4) extends in the second part β of its base circle and in the region of its run-on flank γ.

8. A device according to claim 2, characterized in that the recess (25) of the piston (26) is made as a longitudinal groove whose cam-remote edge (28) forms the control edge and extends at any desired inclination.

9. A tappet according to claim 8, characterized in that the edge (28) possesses a reinforcement (35, 36, 37) at least in a contact region.

10. A tappet according to claim 9, characterized in that the edge (28) comprises a separate component including at leas tone of a needle (35) or a ball (36) in the contact region.

11. A tappet according to claim 2, characterized in that the sliders (11, 14) are displaceable in uncoupling direction by a mechanical spring means (22).

12. A tappet according to claim 11, characterized in that the spring means (22) is at least one compression spring which surrounds the second slider (14) and is fixed at an end nearer the first slider (11) on the second slider (14) or in an annular groove (23) of the second slider (14) while being supported at another end on a diameter reduction of the reception (10) of the second slider (14).

* * * * *